United States Patent [19]

Quehen

[11] 4,027,725

[45] June 7, 1977

[54] DEVICE FOR RESTORATION OF THE MECHANICAL CHARACTERISTICS OF THE METAL BAND IN A CASTING WHEEL FOR CONTINUOUS CASTING OF LIQUID METAL

[75] Inventor: André Quehen, Pontoise, France

[73] Assignee: SECIM, Courbevoie, France

[22] Filed: Nov. 9, 1976

[21] Appl. No.: 739,866

[30] Foreign Application Priority Data

Dec. 3, 1975 France ..... 75.37044

[52] U.S. Cl. ..... 164/278

[51] Int. Cl.[2] ..... B22D 11/06

[58] Field of Search ..... 164/278, 87, 76, 270; 72/160

[56] References Cited

UNITED STATES PATENTS

| | | | |
|---|---|---|---|
| 2,750,984 | 6/1956 | Miller | 72/160 X |
| 3,596,705 | 8/1971 | Murphy | 164/278 |

*Primary Examiner*—Ronald J. Shore

[57] ABSTRACT

A device for restoring the mechanical properties of the metal band used for closing the mould in the wheel of a machine for the continuous casting of liquid metal comprises a plurality of planishing rollers arranged with their axes parallel to the axis of the casting wheel and to bear against opposite faces of the band in a region in which the band is not in contact with the wheel, the rollers being spaced apart in the direction of movement of the band therebetween so that they are not opposite one another.

2 Claims, 1 Drawing Figure

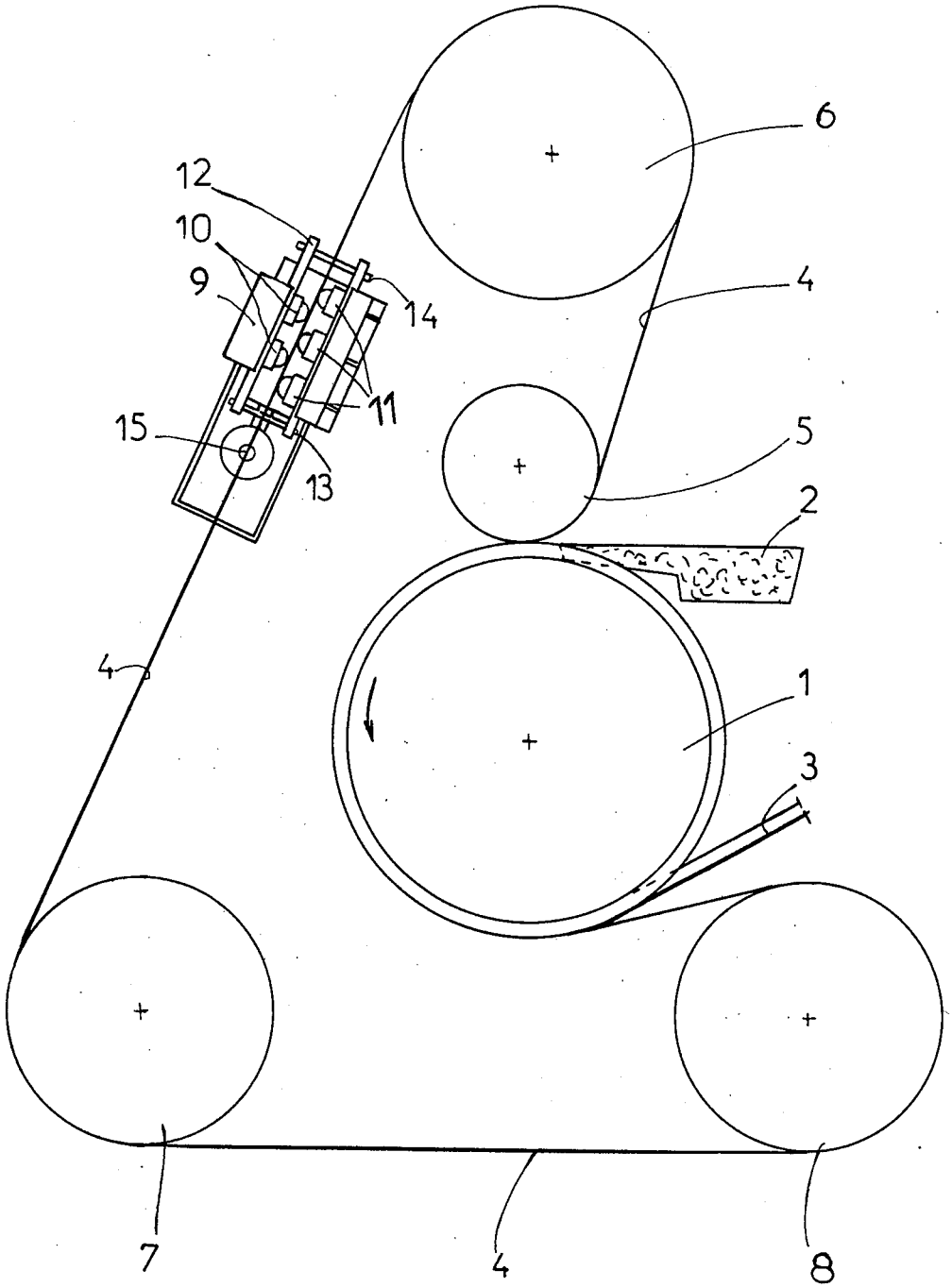
6
12
10
9
14
4
11
15
5
13
2
4
1
3
7
4
8

DEVICE FOR RESTORATION OF THE MECHANICAL CHARACTERISTICS OF THE METAL BAND IN A CASTING WHEEL FOR CONTINUOUS CASTING OF LIQUID METAL

The invention relates to a device for the restoration of the mechanical properties of the metal band used to close the mould of a machine for continuous casting of liquid metal.

Wheel-type continuous casting machines comprise a casting wheel the periphery of which is formed with a groove which is covered over a portion of the circumference of the wheel by an endless metal band which defines with the groove a rotary mould for the liquid metal. The endless band is supported and placed under tension by pulleys. The band is produced from stable materials, for example, low carbon steel of the type employed for sheet for stamping.

Nevertheless these bands slowly lose their mechanical characteristics during the course of the casting operations in which the band is in contact with metal which is liquid or in the course of solidification which keeps it at a temperature such that the band may undergo a tempering which may alter its mechanical properties. Further, the band is not at a temperature which is constant with time but on the contrary undergoes thermal cycles and the faces of the band are in contact with media at very different temperatures.

All these factors are the cause of an evolution in the mechanical characteristics of the bands. In particular a constant reduction with time has been observed in the elastic limit in bands for closure of continuous casting moulds. This deterioration in the mechanical properties may lead to the formation of surface flaws in the band and premature breakage of the bands.

Hence it is altogether desirable to limit or prevent this evolution of the mechanical characteristics of the material of the band.

According to the invention there is provided a device for the restoration of the mechanical properties of the metal band used for closing the mould of a machine for continuous casting of liquid metal and comprising a casting-wheel the periphery of which is provided with a groove covered over a portion of the circumference of the wheel by the endless metal band which defines with the groove a rotary mould for the liquid metal, the device comprising planishing rollers arranged with their axes parallel with the axis of the casting wheel and to be located on opposite sides of the band in a zone where the band is not in contact with the casting wheel, a frame, means for mounting said rollers for rotation in said frame and so as to bear against the two faces of the band and so that said rollers are not opposite one another on each side of the band, and means for connecting said frame to the frame of said machine.

The invention will be more fully understood from the following description of an embodiment of a device in accordance with the invention, given by way of example only, with reference to the accompanying drawing.

In the drawing the single FIGURE represents in elevation a casting machine including an embodiment according to the invention for cold-rolling the band.

In the drawing there is shown a casting wheel 1 which receives liquid metal from a horizontal tank 2 at its upper part and forms a metal bar 3 which leaves the wheel at its lower part. Between the point of introduction of the liquid metal and the point of outlet of the solidified bar, devices for cooling by sprinkling (not shown) enable solidification of the bar. The metal band 4 closes the groove in the wheel 1 to define the mould from a point adjacent the point of introduction of the liquid metal, where a pressure wheel 5 keeps the band in contact with the outer periphery of the casting ring, to the point where the bar 3 is extracted from the casting wheel. The band, constituted as an endless strip, is held in tension by three pulleys 6, 7 and 8. These pulleys together with the pressure wheel 5 and with the aid of other devices for flattening the band against the wheel 1 promote good contact between the band and the outer face of the casting wheel, watertightness of closure of the mould by the band being necessary for avoiding entry of water into the plant.

After its passage over the casting wheel, where one of its faces is in contact in succession with the liquid metal and then with the metal in course of solidification and the other of its faces is in contact with the cooling liquid, the band undergoes cooling in air before its next passage over the casting wheel where the band is again brought to a high temperature. These repeated thermal cycles tend to make the mechanical characteristics of the steel constituting the band 4 decline.

Hence a cold-rolling device is provided, having planisher rollers 9 arranged between the pulleys 6 and 7. This device 9 comprises two sets of planisher rollers 10 and 11 which are located on opposite sides of the band 4 so that any two rollers located on opposite sides of the band do not face one another. These rollers are free to rotate about axes parallel with the axis of the casting wheel in a frame 12, which enables the gap between the rollers to be adjusted by devices 13 and 14 including bolts and nuts. The frame 12 is in turn connected to a support integral or fast with the frame of the machine by means of a suspension arm 15 which enables adjustment of the position of the device 9 with respect to the band.

The gap between the sets of rollers 10 and 11 being adjustable using the devices 13 and 14, the band 4 can be made to undergo more or less heavy bendings leading to cold-rolling which in turn is more or less heavy, during the passage of the band through the device 9 during the course of casting.

This re-cold-rolling may be adjusted so that it leads to a restoration of the mechanical properties of the band 4 after its passage in contact with the hot metal. Thus the cold-rolling during the course of thermal cycles restores the structure and the properties of the band so that the length of life of the band is thus considerably increased.

The invention is not intended to be restricted to the embodiment which has just been described, but on the contrary comprises every variant and one can conceive of the employment of equivalent means without thereby departing from the scope of the invention.

I claim:

1. In a machine for continuous casting of liquid metal comprising a casting-wheel the periphery of which is provided with a groove covered over a portion of the circumference of the wheel by an endless metal band which defines with the groove a rotary mould for the liquid metal, the improvement comprising a device for the restoration of the mechanical properties of the metal band used for closing the mould of the machine, the device comprising planishing rollers arranged with their axes parallel with the axis of the casting wheel and located on opposite sides of the band in a zone where the band is not in contact with the casting wheel, a frame, means for mounting said rollers for rotation in said frame and so as to bear against the two faces of the band and so that said rollers are not opposite one another on each side of the band, and means for connecting said frame to the frame of said machine.

2. The machine as claimed in claim 1, wherein said frame supporting said planishing rollers includes means for adjusting the gap between said rollers in a direction perpendicular to the band.

* * * * *